US009681763B2

(12) United States Patent
Udagawa et al.

(10) Patent No.: US 9,681,763 B2
(45) Date of Patent: Jun. 20, 2017

(54) PRIVACY SCREEN APPARATUS

(71) Applicant: Knoll, Inc., East Greenville, PA (US)

(72) Inventors: Masamichi Udagawa, New York, NY (US); Sigrid Moeslinger, New York, NY (US); Benjamin A. Pardo, New York, NY (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/155,178

(22) Filed: May 16, 2016

(65) Prior Publication Data

US 2016/0345756 A1 Dec. 1, 2016

Related U.S. Application Data

(60) Provisional application No. 62/169,111, filed on Jun. 1, 2015.

(51) Int. Cl.

| | |
|---|---|
| ***H01J 5/00*** | (2006.01) |
| ***A47G 5/00*** | (2006.01) |
| ***A47H 13/02*** | (2006.01) |
| ***A47H 23/04*** | (2006.01) |
| ***A47H 23/08*** | (2006.01) |
| *A47B 97/00* | (2006.01) |

(52) U.S. Cl.

CPC ..... *A47G 5/00* (2013.01); *A47H 13/02* (2013.01); *A47H 23/04* (2013.01); *A47H 23/08* (2013.01); *A47B 2097/003* (2013.01); *A47B 2200/12* (2013.01)

(58) Field of Classification Search

CPC ..... A47G 5/00; A47H 23/08; A47H 23/04; A47H 13/02; A47B 21/06; H02G 3/388

See application file for complete search history.

(56) References Cited

U.S. PATENT DOCUMENTS 5,287,909 A 2/1994 King et al.
5,675,946 A 10/1997 Verbeek et al.
(Continued)

FOREIGN PATENT DOCUMENTS

DE 29718695 U1 12/1997
JP 2010259576 A 11/2010

OTHER PUBLICATIONS

Staples: "Iceberg OfficeWorks Teaming Table Modesty Pouch", May 30, 2013, XP002760726, Retrieved from Internet: URL:https://web.archive.org/web/20130530003334/http://www.staples.com/iceberg-officeworks-teaming-table-modestypouch/products_331311? [retrieved on Aug. 26, 2011].
(Continued)

*Primary Examiner* — Katherine Mitchell
*Assistant Examiner* — Abe Massad
(74) *Attorney, Agent, or Firm* — Buchanan Ingersoll & Rooney PC

(57) ABSTRACT

A privacy screen apparatus can include an upper member having a first end and a second end, at least one first leg connected to the first end of the upper member, at least one second leg connected to the second end of the upper member, and a bendable body connected to the upper member adjacent to a first edge of the body and adjacent to a second edge of the body to define a pouch or channel below the upper member. Cords, cables, or wiring can be positioned in the pouch or channel. The bendable body may also hang from the upper member to provide a visible barrier to provide privacy.

19 Claims, 6 Drawing Sheets

(56) References Cited

U.S. PATENT DOCUMENTS

| | | | | |
|---|---|---|---|---|
| 5,680,893 | A | 10/1997 | Neer | |
| 5,833,332 | A * | 11/1998 | Marshall | A47B 21/06 312/223.3 |
| 5,834,082 | A * | 11/1998 | Day | B29C 44/06 428/316.6 |
| 5,875,594 | A * | 3/1999 | Hellwig | E04B 2/7422 52/220.7 |
| 5,966,879 | A | 10/1999 | Verbeek | |
| D427,783 | S | 7/2000 | Luedke | |
| 6,192,805 | B1 | 2/2001 | Saylor et al. | |
| 6,199,337 | B1 * | 3/2001 | Colson | E04B 9/00 160/327 |
| D457,359 | S | 5/2002 | Chan | |
| D458,040 | S | 6/2002 | Stannis et al. | |
| 6,701,677 | B2 * | 3/2004 | Gresham | E04B 2/7422 52/220.7 |
| 6,896,028 | B2 | 5/2005 | Brennan | |
| 7,207,151 | B2 * | 4/2007 | Swiszcz | E04B 9/001 428/116 |
| 7,789,025 | B2 | 9/2010 | Michaud, II et al. | |
| D653,862 | S | 2/2012 | Hairston | |
| 8,365,798 | B2 | 2/2013 | Feldpausch et al. | |
| 9,084,476 | B2 * | 7/2015 | Mojtabavi | A47B 3/08 |
| 9,364,080 | B2 * | 6/2016 | Rutz | A47B 21/06 |
| 2003/0066936 | A1 * | 4/2003 | Beck | H02G 3/288 248/49 |
| 2008/0283202 | A1 * | 11/2008 | Serio, III | A47H 1/06 160/123 |
| 2009/0255702 | A1 * | 10/2009 | Mitchell | A47B 21/06 174/50 |
| 2013/0304441 | A1 | 11/2013 | Fricke | |

OTHER PUBLICATIONS

Wihtson Gordon: "Ikea Signum Series Cheaply Manages Your Cables", Mar. 21, 2010 XP002760727, Retrieved from the Internet: URL:http://lifehacker.com/5498509/ikea-signum-series-cheaply-manages-your-cables [retrieved on Aug. 11, 2016].

International Search Report for PCT/US2016/032811 dated Aug. 23, 2016.

Written Opinion of the International Searching Authority for PCT/US2016/032811 dated Aug. 23, 2016.

* cited by examiner

PRIVACY SCREEN APPARATUS

CROSS-REFERENCE TO RELATED APPLICATIONS

The present application claims priority to U.S. Provisional Patent Application No. 62/169,111, which was filed on Jun. 1, 2015.

FIELD OF INVENTION

The present innovation relates to furniture such as privacy screen devices and furniture configured to facilitate the distribution of power and data via data cables and power cables.

BACKGROUND OF THE INVENTION

Privacy screens can be utilized to provide a visible barrier in a workplace setting or other setting. Examples of privacy screens can be appreciated from U.S. Pat. Nos. 8,365,798, 7,789,025, 6,896,028, 5,966,879, 5,675,946, 5,680,893, and 5,287,909, U.S. Design Pat. Nos. D653,862, D458,040, D457,359, and D427,783 and U.S. Patent Application Publication No. 2012/0304441. Privacy screens usually only provide a visible barrier. Further, privacy screens may not be easily moved once attached to a structure.

SUMMARY OF THE INVENTION

A privacy screen apparatus is provided. In some embodiments, the privacy screen apparatus may be configured to be moveable. Some embodiments of the privacy screen apparatus can also include a power distribution apparatus that is configured to provide moveable power outlets and/or data management cabling (e.g. Ethernet cables, telecommunications wiring, telecommunications cabling, electricity transmission cabling, electricity transmission wiring, power cords, computer device related wiring, other data cabling or wiring, etc.).

A privacy screen apparatus is provided that includes an upper member having a first end and a second end, at least one first leg connected to the first end of the upper member, and at least one second leg connected to the second end of the upper member. A bendable body can be connected to the upper member adjacent to a first edge of the body and adjacent to a second edge of the body to define a pouch or channel below the upper member. The second edge of the body may be opposite the first edge of the body.

In some embodiments, the can have a first outer face extending from the first edge to the second edge and a second inner face extending from the first edge to the second edge. The second inner face can define the inner walls of the pouch or channel. At least one of cords, cables, and wiring may be positionable in the pouch or channel.

The upper member can have a number of configurations. For instance, the upper member may be a beam, rail, or other member that has a polygonal, elliptical or other type of cross sectional shape. In some embodiments, the upper member has at least one outlet that is connectable to a power source or a source of electricity. For instance, at least one outlet is connectable to a wall outlet for receiving electrical current from the wall outlet for providing electricity to electronic equipment connected to the outlet of the upper member. In some embodiments, each outlet may be connected to a plug that is insertable into an outlet in a wall or floor of a building to connect each outlet to an electricity source.

The first and second legs can have a number of different configurations. In some embodiments, a bottom end of the first leg can be attached to a floor contacting element and a bottom end of the second leg can be attached to a floor contacting element. Each floor contacting element can be comprised of a glide or a castor.

The bendable body can have a number of configurations. In some embodiments, the bendable body can be comprised of foam having a plurality of spaced apart recess regions and a plurality of spaced apart pillow regions that are thicker than the recess regions. The pillow regions may also be wider than the recess regions. The length of the recess regions and the pillow regions may be the same or be substantially the same (e.g. within 10% of the same value, within 5% of the same value, etc.). In some embodiments, the bendable body can have a film or fabric covering attached to an exterior surface of the foam. The covering may cover the outer and/or inner faces of the body.

The bendable body may be bendable into a number of different shapes. For instance, the bendable body can be bendable so that it is generally U-shaped, C-shaped, or V-shaped when the body is connected to the upper member adjacent the first edge and adjacent the second edge of the bendable body.

Embodiments of the privacy screen apparatus can include a plurality of modesty screen connectors attached to the upper member. Each of the modesty screen connectors can have a first projection extending in a first direction away from a body of the modesty screen connector and a second projection extending in a second direction away from the body of the modesty screen connection. The second direction can be opposite the first direction. In some embodiments, the modesty screen connectors may be attached to a lower portion of the upper member within a downwardly facing opening defined in a bottom portion of the upper member.

The bendable body can be configured for operative connection with the modesty screen connectors. For instance, the bendable body can have a plurality of holes adjacent the first edge and a plurality of holes adjacent the second edge. The holes may be defined within the body of the bendable body. The first projections can pass through the holes adjacent to the first edge to connect the bendable body to the upper member adjacent the first edge and the second projections can pass through the holes adjacent to the second edge to connect the bendable body to the upper member adjacent the second edge. In some embodiments, rings may be provided in the holes of the bendable body so that the projections also pass through holes in the rings when passing through the holes of the body. The rings can be positioned in the body to cover the body. The rings can be ring elements such as grommets or annular shaped rings (e.g. annular shaped circular members, annular polygonal shaped members etc.) that have a shape that corresponds to the holes defined in the body adjacent the first and second edges of the bendable body. For instance, embodiments of the privacy screen apparatus can include a plurality of first ring elements where each of the first ring elements are positioned in a respective one of the holes of the bendable body adjacent the first edge and a plurality of second ring elements where each of the second ring elements are positioned in a respective one of the holes of the bendable body adjacent the second edge. The first ring elements can be annular shaped bodies having a circular or polygonal shape and the second ring elements can be annular shaped bodies having a circular or polygonal shape.

The first end of the upper member can be connected to a leg connector. The leg connector can be configured for attaching the at least one first leg to the first end of the upper member. The second end of the upper member can be connected to a leg connector for attaching the at least one second leg to the second end of the upper member. Alternatively, the second end of the upper member can be connected to an inter-upper member connector device to connect the second leg to the second end of the upper member. The inter-upper member connector can be positioned in a downward facing opening of the first upper member adjacent the second end of the first upper member and can also be within a downward facing opening of a second upper member adjacent a first end of the second upper member to connect the first and second upper members together.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of privacy screen apparatuses are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
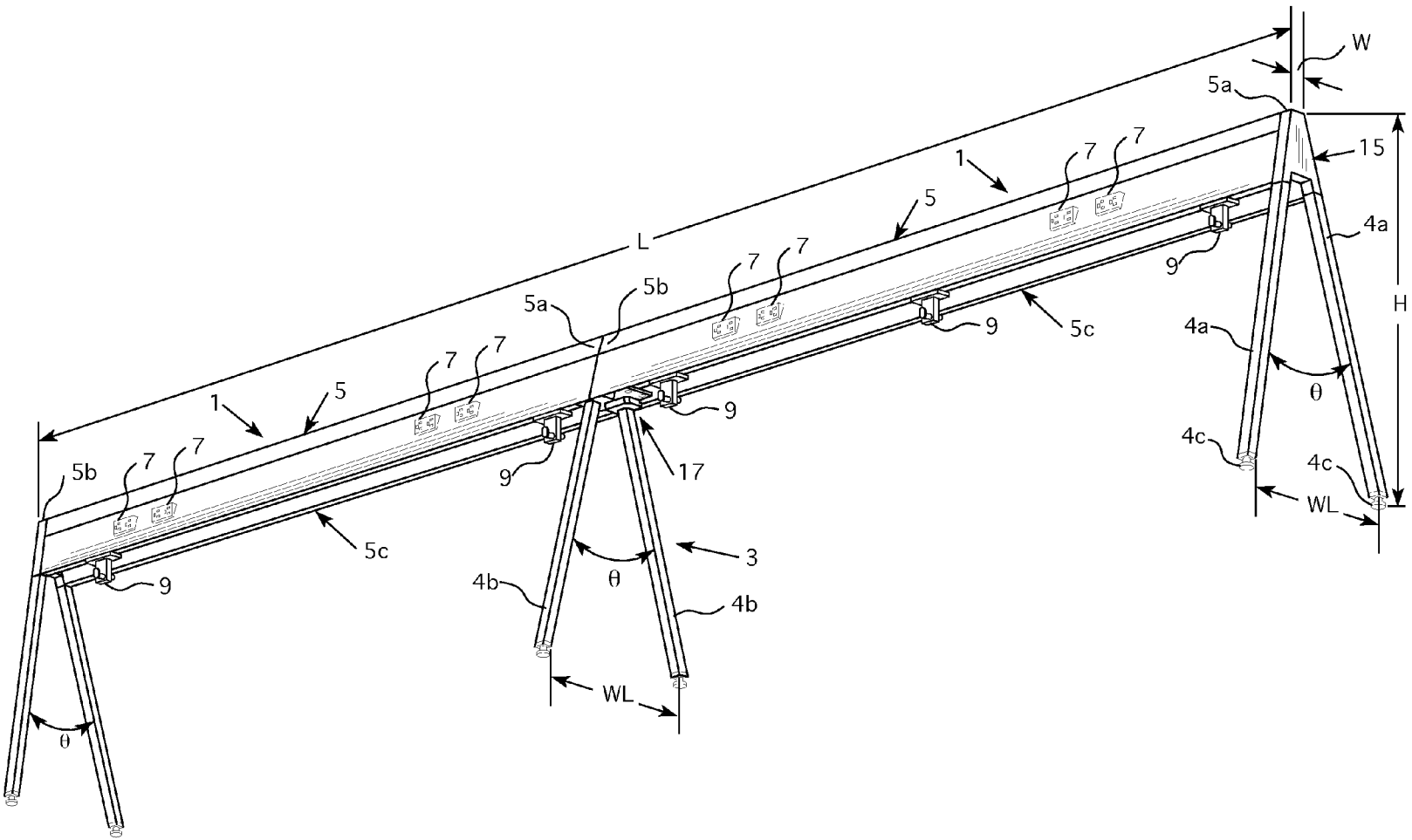
FIG. 1 is a perspective view of multiple interconnected first embodiments of a privacy screen apparatus with the flexible body element being unattached to the apparatus.
Figure 2:
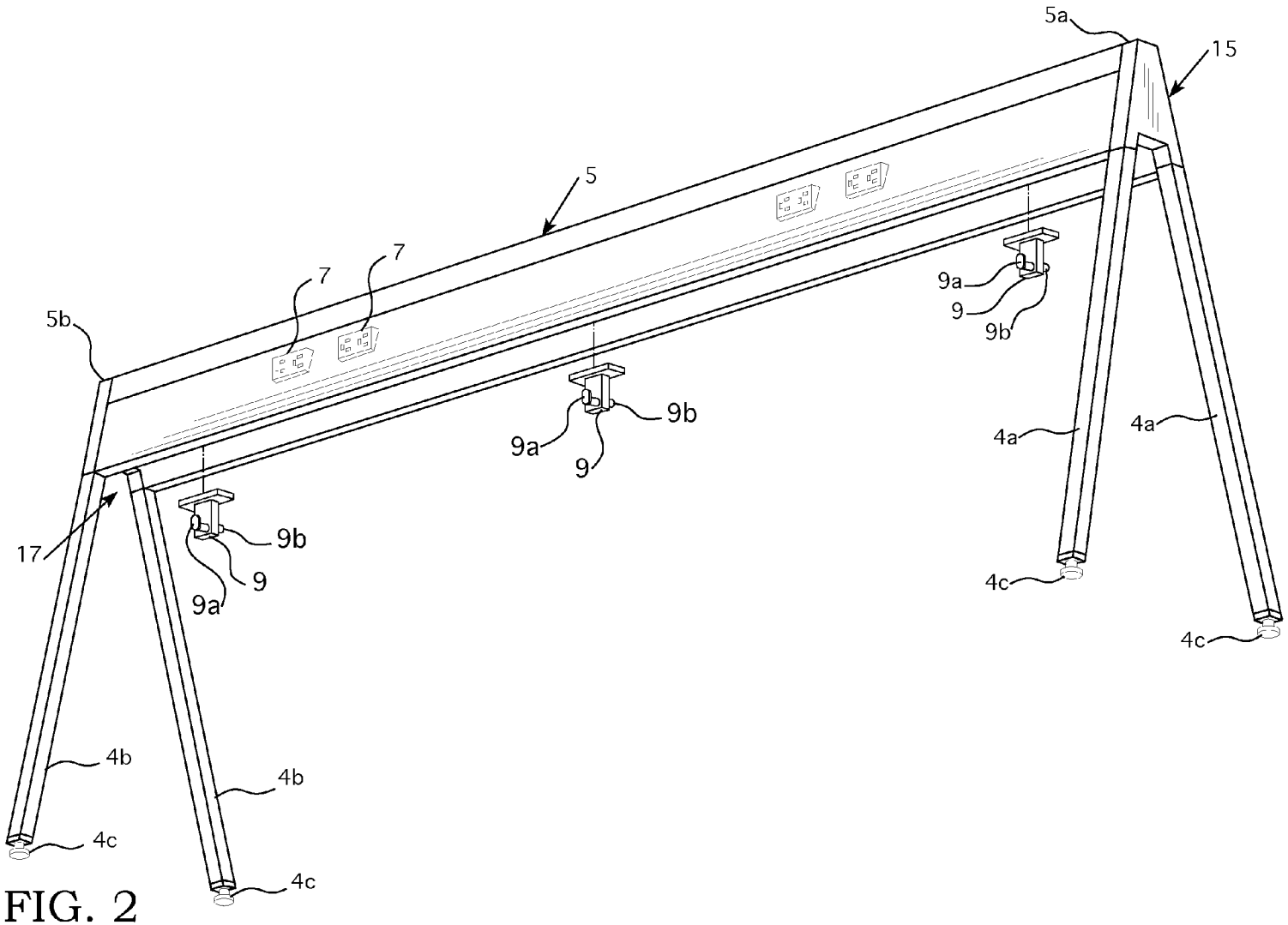
FIG. 2 is an exploded view of a single first exemplary embodiment of a privacy screen apparatus.
Figure 3:
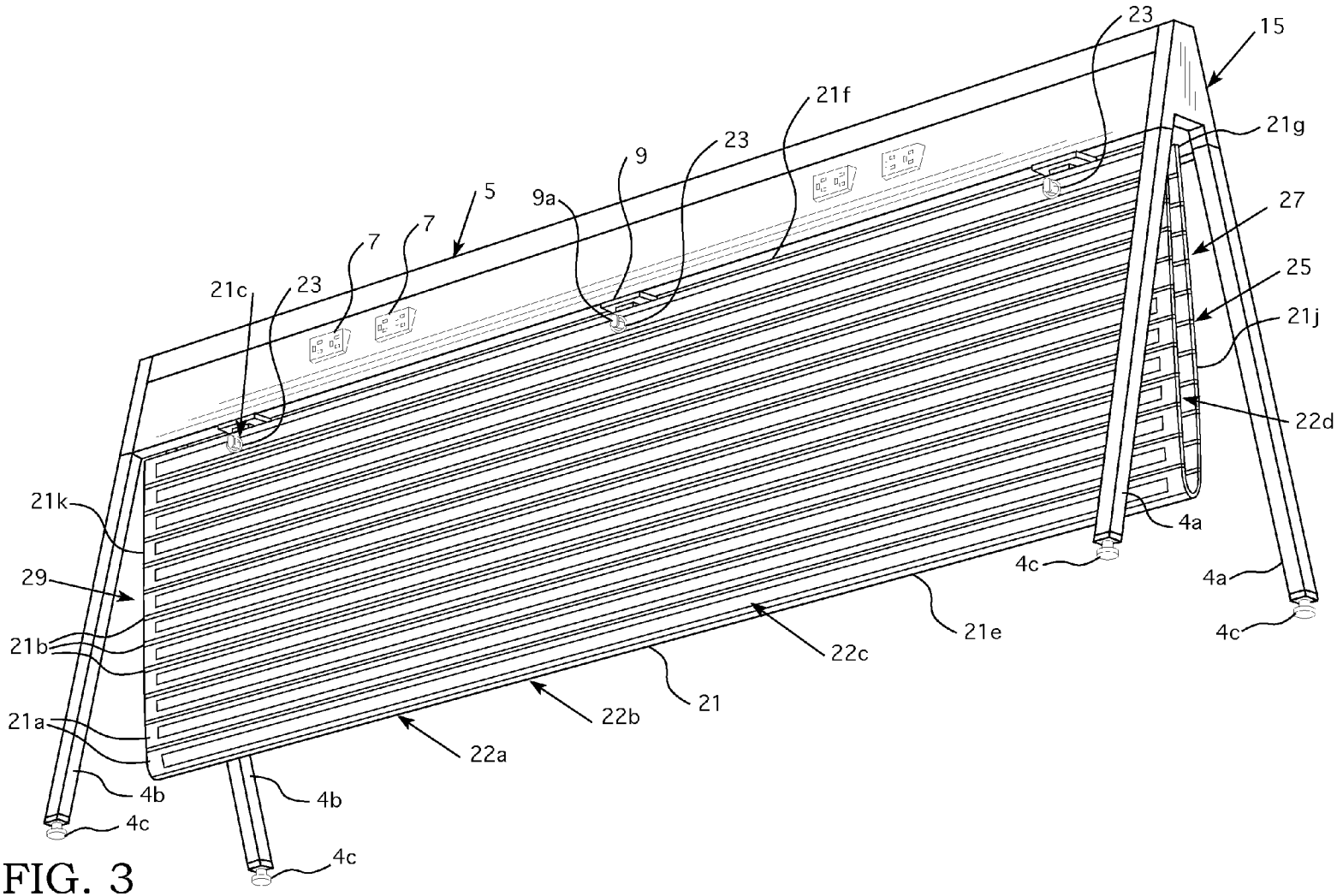
FIG. 3 is a perspective view of the first exemplary embodiment of the privacy screen apparatus with the flexible body element attached to the apparatus.

Referring to FIGS. 1-6, a privacy screen apparatus 1 can include a base 3 that supports an upper member 5. The upper member 5 may be structured as an elongated member that extends between different sets of legs. In some embodiments, the upper member 5 may be configured as a beam, rail, rod, or other type of elongated member that is elongated from its first end 5*a* to its second end 5*b*. The base can include a first set of first legs 4*a* can be attached to the first end 5*a* and a second set of second legs 4*b* can be attached to the second end 5*b* of the upper member 5. In some embodiments, the upper member 5 may be configured as a top member to define the top of the privacy screen apparatus 1. In other embodiments, another element may be connected to the upper member 5 and extend above the upper member 5.

Leg connectors 15 can be attached to the first and second ends 5*a* and 5*b* of the upper member 5 for attaching the first and second sets of first legs 4*a* and second legs 4*b* to the upper member 5. The bottom ends of the legs may be connected to floor contacting elements 4*c*, which may be glides, wheeled castors, or other type of floor contacting element. Such an embodiment of the privacy screen apparatus may have a length L defined primarily by only one upper member 5, and a height H defined primarily by the legs. The width W of the upper member 5 at its greatest width (which can also be considered its depth, or thickness) may primarily define the width W of the upper member 5. The width of the privacy screen apparatus may be defined by the width W of the upper member 5 or may be considered to be the width based on an area of a floor the privacy screen apparatus may take up based on the width WL as defined by the spacing between terminal ends of its first and second sets of legs 4*a* and 4*b*.

In other embodiments, a first end 5*a* of a first upper member 5 may include a leg connector 15 and a second end 5*b* may be configured for attachment to a second upper member 5 for forming a longer privacy screen apparatus 1 that may include multiple upper members 5. For such embodiments, the first upper member 5 may be connected to the second upper member 5 by an inter-upper member connector 17. The inter-upper member connector 17 may include, for instance, a bracket or other type of connector that is positioned within a downward facing opening 5*c* of the upper member 5 that is configured for attachment to at least one leg (e.g. only one leg or multiple legs, such as, for instance, a pair of legs). For example, the inter-upper member connector 17 may be positioned in the opening 5*c* between the second end 5*b* of a first upper member 5 and a first end 5*a* of a second upper member 5 for connection to the upper members 5 via one or more fasteners. The inter-upper member connector 17 can be so positioned for connection to a pair of downwardly extending legs that extend downwardly relative to each other at an angle θ for supporting the first end 5*a* of the second upper member 5 and the second end 5*b* of the first upper member 5. The legs may be connected via fasteners or other type of fastening mechanism or may be formed to be integral to a bracket or other element of the inter-upper member connector 17. The upper ends of each of the legs connected to the inter-upper member connector 17 may be positioned inside the downward facing openings 5*c* of the first and second upper members between the second end 5*b* of the first upper member and the first end 5*a* of the second upper member.

For such embodiments that utilize at least one inter-upper member connector 17, the second upper member 5 may have a leg connector 15 attached at its second end to define the privacy screen apparatus embodiment having a length L that is equal to or substantially equal to (e.g. within 5% or within 10% of the overall length) the combined lengths of the first and second upper members. In yet other embodiments, the second end 5*b* of the second upper member 5 may be connected to another inter-upper member connector 17 for connection to the first end 5*a* of a third upper member, which may have its second end connected to a leg connector 15 or yet another inter-upper member connector 17 for connection to a fourth upper member. The number of upper members being interconnected together via inter-upper member connectors 17 may substantially define the length of the formed privacy screen apparatus. The terminal ends of such apparatuses can have leg connectors 15 attached thereto for attaching legs to the terminal ends of the privacy screen apparatus. The leg connectors 15 for such embodiments can also be structured to be end-caps to the upper members of the privacy screen apparatus at its terminal ends.

The first set of first legs 4*a* may include a pair of legs that extend downwardly from the upper member 5 at an angle θ relative to each other and the second set of second legs 4*b* may also include a pair of legs that extend downwardly from the upper member 5 at an angle θ relative to each other. In some embodiments, the angle θ can be set so that the legs extend from the upper member so that the upper member and the legs provide an appearance of a "saw horse" type structure. For instance, in some embodiments the angle θ can be between 10° and 65°, between 20° and 60°, between 25° and 50°, between 30° and 45° or between 30° and 40°. For embodiments utilizing multiple upper members, which may have more than two sets of legs, each set of legs may include a pair of legs that extend downwardly from the upper member at an angle of θ relative to each other.

The upper member 5 can be configured to facilitate the routing of electricity conducting wiring or cabling and may include electrical outlets 7 and/or data connection outlets (e.g. data jacks, Ethernet cable jacks, etc.). In some embodiments, a universal serial bus (USB) jack may be defined in at least one of the outlets 7, that is configured to facilitate connection of a device to a source of electricity and/or a connection to another electrical device (e.g. a router or access point) and/or a data network. The wiring for the transmission of electricity from a source of electricity to the outlets 7 may extend through an inner channel defined in the upper member that is above the downwardly facing opening 5*c*. The inner channel may be entirely enclosed from the downwardly facing opening 5*c* or may be accessible via this opening. In some embodiments, a terminal end of the wiring may extend from the upper member and include a plug for attachment to an outlet of a wall to connect the outlets 7 to a source of electricity via the wall outlet.

In some embodiments, a vertically extending in-feed conduit can be connected to the upper member 5. The in-feed conduit may have at least one channel defined therein throughout the length of the conduit for passing wiring therethrough to connect to wiring in the upper member 5. For instance, power wires, data transmission cables, and voice communication transmission cables can be passed through the in-feed conduit for connection to wiring in the upper member. In some embodiments, the in-feed conduit may be connected to the upper member 5 adjacent to or inside of the downward facing opening 5*c* of the upper member 5 via at least one fastening mechanism (e.g. a connector, fasteners, a combination of a bracket and fasteners, etc.) and extend downwardly from the upper member to the floor on which the upper member is supported or near the floor. The in-feed conduit may extend perfectly vertically or at an angle to a position adjacent a wall outlet and/or data jack on a wall or adjacent to a floor outlet and/or power jack located on the floor.

In other embodiments, it is contemplated that the upper member may enclose or be attached to a battery or other source of electricity. In embodiments having the battery, the battery may be rechargeable via at least one solar cell or may be rechargeable by being connected to a source of electricity, such an a wall outlet of a building connected to an electrical grid, via a recharging connection (e.g. a wired connection having plugs for connecting between the battery and wall outlet, etc.).

The upper member 5 may also be connected to a plurality of modesty screen connectors 9. Each modesty screen connector 9 can be configured for positioning within the downwardly facing opening 5*c* for connection to the upper member via one or more fasteners (e.g. bolts, screws, etc.), or other type of fastening mechanism (e.g. a profile configured to mate and interlock with a profile of the upper member formed inside the opening 5*c*, adhesive, welding, etc.). Each modesty screen connector 9 can include a plurality of projections. The projections may include a first projection 9*a* that extends away from a body of the modesty screen connector in a first direction and a second projection 9*b* that extends away from the body of the modesty screen connector 9 in a second direction that is opposite the first direction. In some embodiments, the opposing pair of projections may be defined by a single rod or other member that may pass through an opening in the body of the modesty screen connector 9 so that its opposed ends are located at opposite sides of the body and are positioned away from the body so that they are spaced apart from the body. In other embodiments, the projections may be integrally formed portions of the body of the modesty screen connector 9. The projections may be configured as hooks, teeth or other type of projection. The distal end (e.g. terminal end) of each projection may be shaped to receive and retain a portion of a modesty screen that may be passed through the projection (e.g. an upwardly extending retention profile, etc.).

A modesty screen 21 can be connected to the upper member 5 and be configured to hang downwardly from the upper member to adjacent a floor. In most contemplated embodiments, the lower part of the modesty screen 21 that may hang from the upper member 5 may not contact a floor by being spaced from the floor by a gap of at least a few centimeters. But, in other embodiments, it is contemplated that the modesty screen 21 may hang from the upper member such that it does contact a floor or almost contacts the floor. The modesty screen 21 may be connected to the upper member 9 via the modesty screen connectors 9.

The modesty screen 21 can be a body 22*a* that is composed of an ethylene vinyl acetate (EVA) and polyethylene (PE) foam (e.g. an EVA+PE foam) or other type of foam that may have a covering 22*b* that is on the entire exterior of the polyethylene foam or that is on a substantial portion of the exterior surface of the polyethylene foam body (e.g. covers 70% or more of the exterior surface, 80% or more of the exterior surface, 90% or more of the exterior surface, etc.). In other embodiments, the body 22*a* can be composed of a polyethylene foam or other type of foam that has a fabric covering 22*b*, a film covering 22*b*, or other type of covering 22*b* that is positioned over the entirety of the external surface of the foam or over a substantial portion of the exterior surface of the foam. In yet other embodiments, the body 22*a* may not have any covering 22*b* and/or may be composed of another type of material. For instance, in some embodiments the body 22*a* can be composed of an elastomeric material such as, for example, a thermoplastic elastomer (TPE) such as a thermoplastic polyester elastomer, a thermoplastic copolyester elastomer (TPC-ET), a polyetherester block copolymer, styrenic block copolymers (TPE-s), a polyolefin blend (TPE-o), elastomeric alloy (TPE-v or TPV), a thermoplastic polyurethane (TPU), a thermoplastic copolyester, or a thermoplastic polyamide or may be composed of another type of elastomeric material. For instance, a body can be composed of a thermoplastic copolyester elastomer that is sold under the Hytrel brand name by E. I. du Pont de Nemours and Company and/or its affiliates.

The body 22*a* can be have a length LM, a width WM, and a thickness T. The body 22*a* can be configured to include sections having different thicknesses, such as less wide recess sections that are thinner than wider, stiffer, pillow sections. The pillow and recess sections can extend along the entire length LM of the body 22*a* and/or may be defined to extend along a substantial portion of the length LM of the body 22*a* (e.g. 80% of the length LM, 90% of the length LM, 95% of the length LM, etc.).

The thickness T of the body 22*a* may vary throughout the length LM and width WM of the body 22*a*. The variable thickness may change along discreet sections of the body as the body extends along its length LM and width WM. For instance, pillow sections 21*a* of the body 22*a* may be thicker than recess sections 22*b* of the body 22*a* and may also be stiffer than the recess sections 21*b* of the body 22*a*. The thickness of each pillow section 21*a* may be a uniform thickness and the thickness of each recess section 21*b* may be a uniform thickness. In some embodiments, a lip can be defined at the first side of each recess section 21*b* by a side of a first pillow section 21*a* that defines that first side and a lip can be defined at the second side of each recess section 21*b* by a second pillow section 21*a* that is immediately adjacent to the first pillow section 22*a* that is located at that second side of the recess section 21*b*. The lips can define the interface region between the recess section 21*b* and the pillow sections 21*a* that define that recess section 21*b*. In some embodiments, the lips may extend linearly or may be configured to extend about a curve.

The pillow sections 21*a* and recess sections 21*b* may be defined on a first outer face 22*c* and an opposite second inner face 22*d* of the body 22*a*. The first outer face 22*c* and second face inner 22*d* may extend between a first edge 21*f* and a second edge 21*g* opposite that first edge 21*f*. The width WM of the body 22*a* may extend from the first edge 21*f* to the second edge 22*g*. The first outer face 22*c* and second inner face 22*c* may also be defined by a third edge 21*k* and a fourth edge 21*j* that extend from the first edge 21*f* to the second edge 21*g* at opposite sides of the body 22*a*. The body may extend along its length LM between the third and fourth edges 21*k* and 21*j*.

The body 22*a* can be structure so that there are a plurality of spaced apart recess sections 22*b* that each have an elongated recess such as, for example, a trench, a groove, a furrow, a channel, or other type of recess defined between immediately adjacent pillow sections 21*a*. Immediately adjacent pillow sections 21*a* may be spaced apart from each other by a respective one of the recess sections 21*b*.

The pillow sections 21*a* may be regions or sections of the body 22*a* that are thicker than the recess sections 21*b* having the recesses defined therein. The width WP of each pillow section 21*a* may be greater than the width WR of each recess section 21*b*, while the lengths of the pillow sections 21*a* may be equal to or substantially equal to the length of the recess sections 21*b* (e.g. within 10% of the lengths of the pillow sections, within 5% of the lengths of the pillow sections, equal to the lengths of the pillow sections etc.) The thicknesses of the pillow sections 21*a* may be greater than the thicknesses of the recess sections 21*b* of the body 22*a*.

The recess sections 21*b* can be defined to provide flexibility in the body 22*a*. For instance, the defined recess sections 21*b*, which are thinner than the pillow sections 21*a*, can allow the body 22*a* to be curved or otherwise configured by a user so that the body bends about the length of one or more of the recess sections 21*b*. The stiffer pillow sections 21*a* may not bend, or may bend substantially less than the recess sections 21*b* such that the bending of the body 22*a* is primarily provided by the recess sections 21*b* defined in the body 22*a*. The bendability of the body 22*a* can allow the body 22*a* to be moved into multiple different configurations to attachment of the modesty screen 21 to the upper member 5 and removal of the modesty screen 21 from the upper member 5.

The body 22*a* can be structured to define a plurality of holes 21*c* adjacent the first and second edges 21*f* and 21*g*. The holes 21*c* may be spaced apart from each other to correspond to locations at which projections of the modestly screen connectors 9 may extend for attachment to the modesty connectors 9. Grommets, O-rings, or other type of ring elements 23 can be positioned in the holes 21*c* to cover the body portion defining each hole and provide reinforcement to the body 22*a*. The ring elements 23 can be annular shaped bodies configured to facilitate connection of the body 22*a* to the modesty screen connectors 9. The holes 21*c* and ring elements may be configured to be circular in shape or may have another shape such as an oval shape or a polygonal shape (e.g. hexagonal, octagonal, triangular, etc.). The ring elements may be rings having an annular body of a shape that corresponds to the shape of the holes 21*c* (e.g. annular shaped circles, ovals, triangles, diamonds, squares, hexagons, etc.). The body of each ring element may define an inner opening through which a projection of the modesty screen connector can pass.

Figure 4:
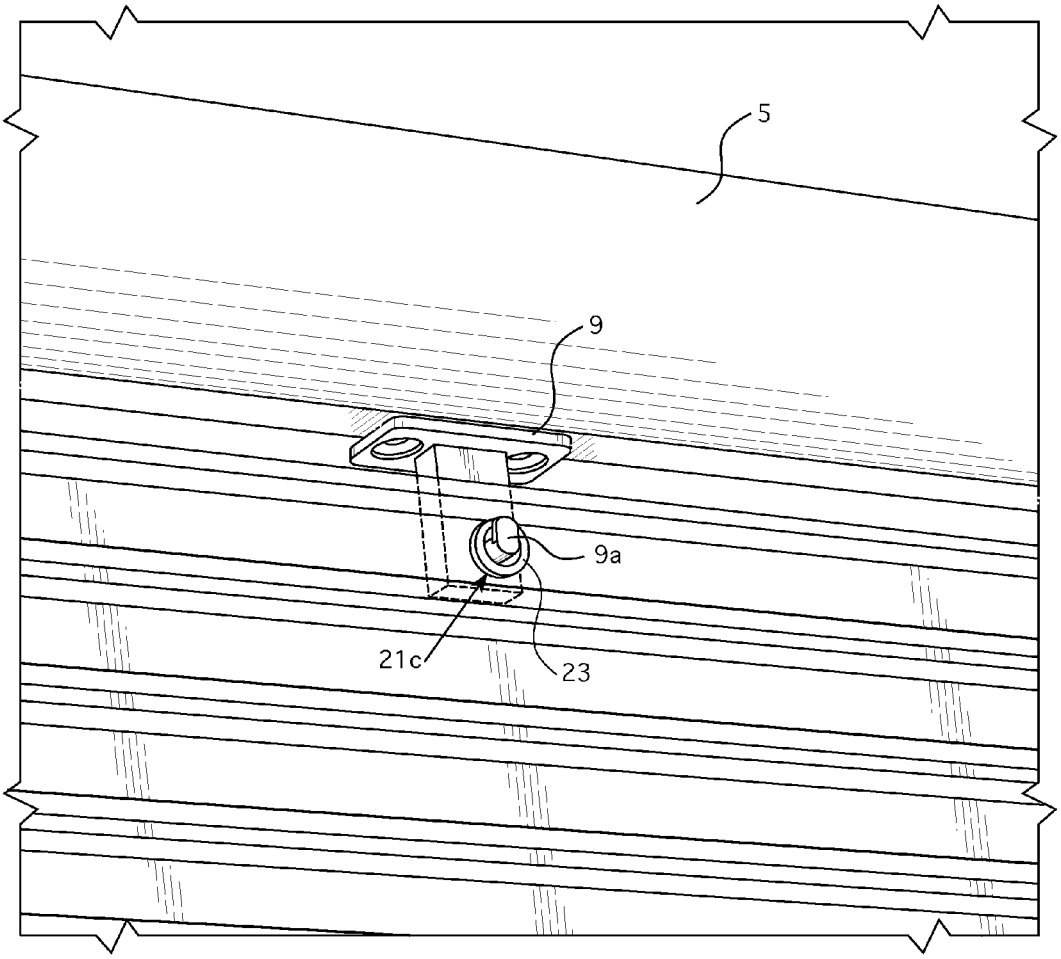
FIG. 4 is an enlarged fragmentary view of the first exemplary embodiment of the privacy screen apparatus with the flexible body element attached to the apparatus.
Figure 5:
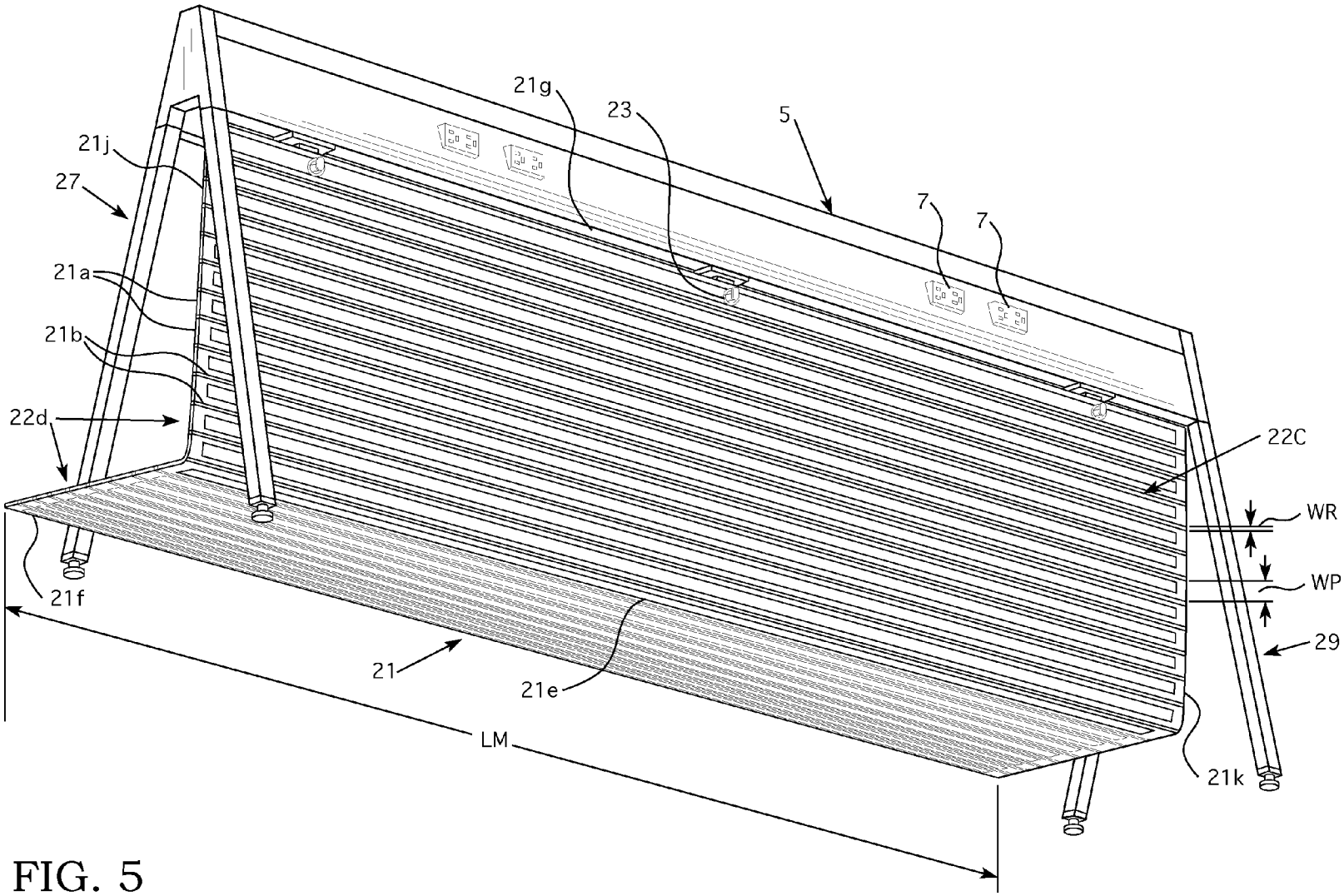
FIG. 5 is a perspective view of the first exemplary embodiment of the privacy screen apparatus with a first side of the flexible body element unconnected to the apparatus and a second side of the flexible body element connected to the apparatus.
Figure 6:
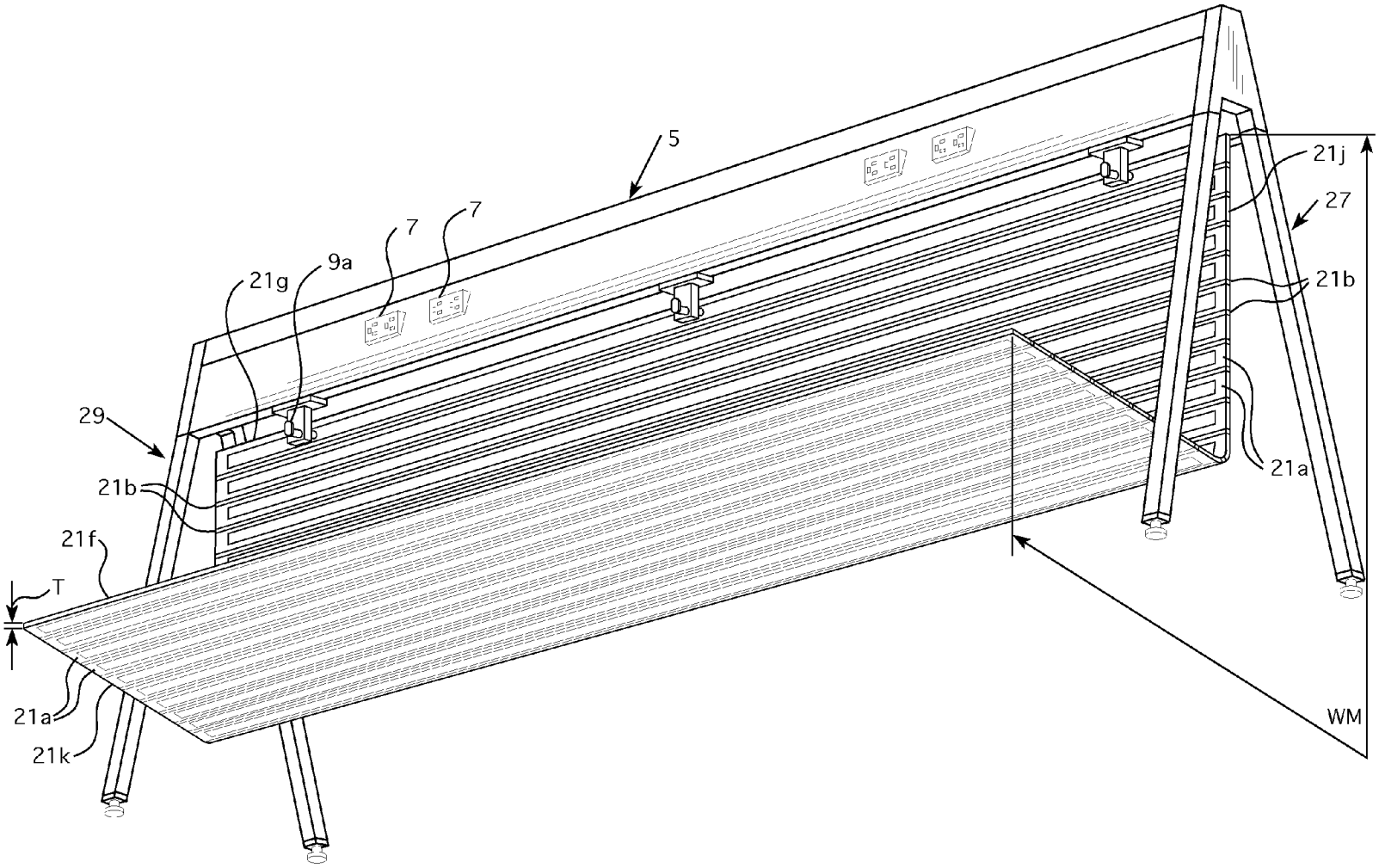
FIG. 6 is a perspective view of the first exemplary embodiment of the privacy screen apparatus with the first side of the flexible body element unconnected to the apparatus and the second side of the flexible body element connected to the apparatus.

In some embodiments, it is contemplated the first and second projections 9*a* and 9*b* may include a magnetic element that is configured to attract a magnetic element of the ring elements 23 or is configured to be attracted to a magnetic element of the ring element 23. In other embodiments, no such magnetic elements may exist, and the terminal ends of the projections may be shaped or sized to pass through the ring elements 23 and holes 21*c* and be configured to engage a portion of the body 22*a* and/or ring element 23 for holding the ring element 23 and portion of the body 22*a*. FIG. 4 provides an enlarged view of one such example of a projection passing through hole 21*c* and ring element 23 for holding of the portion of the body 22*a* and attachment of the body 22*a* to the upper member 5 via a projection of a modesty screen connector 9.

When attaching the first and second edges 21*f* and 21*g* of the body 22*a* of the modesty screen 21 to the first and second projections 9*a*, 9*b* of the modesty screen connectors 9 to connect the modesty screen to the upper member 5, the body 22*a* can be configured to bend at at least one of the recess sections at a midpoint 23*e*, which may be central region, of the body 22*a*. For instance, the second edge 21*g* may be connected to second projections 9*b* that project in a second direction by passing holes 21*c* having ring elements 23 positioned therein through the second projections 9*b*. The body 22*a* may then be bent at midpoint region 21*e*, which is at a midpoint of the width WM of the body 22*a* so that the first edge 21*f* may be connected to the first projections 9*a* of the modesty screen connectors 9 by having the first projections 9*a* pass through the holes 21*c* and ring elements 23 positioned in those holes 21*c* adjacent the first edge 21*f*. The distal terminal ends of the first and second projections may have a profile for contacting or engaging a portion of the ring elements 23 and/or body 22*a* adjacent the holes 21*c* for retaining the first and second edges 21*f* and 21*g* and holding the body 22*a*. The body 22*a* may be held by the projections of the modesty screen connectors so that the first and second edges are close to the bottom of the upper member 5. For instance, there may be only a relatively small gap between the first and second edges 21*f* and 21*g* and the bottom of the upper member 5 or there may not be a gap as the first and second edges 21*f* and 21*g* may be pulled into contact with the bottom of the upper member 5, configured to extend over the a portion of the bottom of the upper member 5, or be configured to pass into the downward facing opening 5*c* of the upper member 5 when connected to the modesty screen connectors 9 for hanging from the upper member 5. When the first and second edges 21*f* and 21*g* of the body 22*a* are connected to the first and second projections 9*a* and 9*b*, the body 22*a* may be shaped so that the body is configured or oriented like a "U", "C", or "V".

The modest screen 21 can be configured to provide a visible barrier to provide privacy to a worker who may be working near the privacy screen apparatus and using a computer device or other electronic equipment that may be connected to an outlet 7 of the privacy screen apparatus 1 to power the equipment that person may be using to perform a work related task.

The modesty screen 21 may be folded such that the inner face 22*d* of the body 22*a* defines a pouch or other type of channel 25 that extends from a first side 29 of the channel 25 that is defined by the third edge 21*k* to a second side 27 that is defined by the fourth edge 21*j*. Data management cables, electricity conducting cables such as extension cords, power cords, Ethernet cords, data communication cords, voice communication cords, or other type of cords, cables or wiring, or other types of cords or wiring may be positioned inside the pouch or other type of channel 25 defined by the body 22*a* of the modesty screen 21 when it is attached to the modesty screen connectors 9 adjacent to its first and second edges 21*f* and 21*g* via the holes 21*c* and defined in the body 22*a* by these edges. Such cabling, cords, or other type of wiring may rest at the bottom of the pouch or other type of channel 25 that may be defined by the midpoint region 21*e* of the body 22*a* at which the body 22*a* is bent or folded during the connection of the modesty screen 21 to the upper member 5 and the portions of the body on opposite sides of this midpoint that extend from this midpoint to adjacent the upper member 5.

It is contemplated that embodiments of the privacy screen apparatus can provide for a mobile privacy screen that can also provide a visibly attractive structure by which cable, cords, and/or wiring may be passed while substantially hidden from view. For instance, when floor contacting elements are castors, the privacy screen apparatus 1 may be rolled along a floor to a desired location, then have a plug connected to an outlet for powering the outlets 7, and be positioned to receive and hide data management cables and/or other wiring, cables and/or cords in the pouch or other channel 25. When the floor contacting elements 4*c* are glides the privacy screen apparatus may be slid along the floor to a desired location. The mobile power outlets 7 provided via the upper member 5 and legs, along with the privacy barrier provided by the hanging modesty screen 21 and the ability to pass cabling, cords and/or wiring via the channel 25 can provide a moveable privacy screen apparatus that also provides for powering of multiple user devices so that a particular work area can have its structure or layout changed easily to accommodate different uses or desired floor layouts while also covering wiring or other cabling from view via the pouch or other channel 25. Such mobile privacy screen apparatuses can provide an attractive element for floor layout organization and a mechanism by which different types of cords or wiring (e.g. power and data cords) can be utilized so that power and data management for users at different regions of a floor layout can be easily facilitated via outlets 7 and data management cords or cabling that may be passed through the pouch or other channel 25 while substantially hiding the cords, cabling, or wiring used to provide such power and data to different users from a user's view.

It should be understood that modification to the privacy screen apparatuses 1 can be made to meet a particular set of design criteria. For instance, the size, shape and weight of the body 22*a* and the length, width, and depth of the upper member 5 can be any size or shape to meet a particular set of design criteria. As another example, the size and shape of the pillow sections 21*a* and recess sections 21*b* may be any suitable size and shape for meeting a particular set of design criteria and/or to provide a desired aesthetic effect. As another example, the type of covering 22*b*, the use of a covering 22*b*, and/or the extent to which a covering 22*b* may cover an exterior surface of a body 22*a* can be adjusted as needed to meet particular design criteria and/or to provide a desired aesthetic effect. As yet another example, length and size of the legs of the base can be any size or shape that is required to meet a particular set of design criteria. As yet another example, the feet can be being connected to floor contacting elements 4*c* such as glides or castors or be configured so that their terminal ends are to contact the floor.

Therefore, while certain exemplary embodiments of privacy screen apparatuses, and methods of making and using the same have been discussed and illustrated herein, it is to be distinctly understood that the invention is not limited thereto but may be otherwise variously embodied and practiced within the scope of the following claims.

What is claimed is:

1. A privacy screen apparatus comprising:

an upper member having a first end and a second end;

at least one first leg connected to the first end of the upper member;

at least one second leg connected to the second end of the upper member;

a bendable body having a first edge and a second edge opposite the first edge, the body connected to the upper member adjacent to the first edge of the body and adjacent to the second edge of the body to define a pouch or channel below the upper member;

a plurality of modesty screen connectors attached to the upper member, each of the modesty screen connectors having a first projection extending in a first direction away from a body of the modesty screen connector and a second projection extending in a second direction away from the body of the modesty screen connector, the second direction being opposite the first direction, the modesty screen connectors being attached to the upper member within a lower downwardly facing opening defined in a bottom of the upper member such that the first and second projections of the modesty screen connectors are positioned below the upper member; and wherein the bendable body has a plurality of holes adjacent the first edge and a plurality of holes adjacent the second edge, the first projections passing through the holes adjacent to the first edge to connect the bendable body to the upper member adjacent the first edge, the second projections passing through the holes adjacent to the second edge to connect the bendable body to the upper member adjacent the second edge.

2. The privacy screen apparatus of claim 1, wherein the body has a first outer face of the body extending from the first edge to the second edge and a second inner face of the body extending from the first edge to the second edge, the second inner face defining the pouch or channel.

3. The privacy screen apparatus of claim 1, wherein at least one cord is positionable in the pouch or channel.

4. The privacy screen apparatus of claim 3, wherein the upper member has at least one outlet.

5. The privacy screen apparatus of claim 4, wherein the at least one outlet is connectable to a wall outlet for receiving electrical current from the wall outlet for providing electricity to electronic equipment connected to the outlet of the upper member.

6. The privacy screen apparatus of claim 5, wherein a bottom end of the first leg is attached to a floor contacting element and a bottom end of the second leg is attached to a floor contacting element.

7. The privacy screen apparatus of claim 6, wherein each floor contacting element is comprised of a glide or a castor.

8. The privacy screen apparatus of claim 5, wherein the bendable body is comprised of foam having a plurality of spaced apart recess regions and a plurality of spaced apart pillow regions, the pillow regions being thicker than the recess regions.

9. The privacy screen apparatus of claim 8, wherein the bendable body has a film or fabric covering attached to an exterior surface of the foam.

10. The privacy screen apparatus of claim 8, wherein the bendable body is U-shaped, C-shaped, or V-shaped when the body is connected to the upper member adjacent the first edge and adjacent the second edge of the bendable body.

11. The privacy screen apparatus of claim 1, comprising:

a plurality of first ring elements, each of the first ring elements positioned in a respective one of the holes of the bendable body adjacent the first edge to cover a portion of the bendable body defining a periphery of the hole in which the first ring element is positioned to reinforce the bendable body adjacent the hole in which the first ring element is positioned; and a plurality of second ring elements, each of the second ring elements positioned in a respective one of the holes of the bendable body adjacent the second edge to cover a portion of the bendable body defining a periphery of the hole in which the second ring element is positioned to reinforce the bendable body adjacent the hole in which the second ring element is positioned; and wherein the modesty screen connectors are attached to the upper member between the first end and the second end of the upper member.

12. The privacy screen apparatus of claim 11, wherein the first ring elements are annular shaped bodies having a circular or polygonal shape; and the second ring elements are annular shaped bodies having a circular or polygonal shape.

13. The privacy screen apparatus of claim 1, wherein the first end of the upper member is connected to a leg connector, the leg connector attaching the at least one first leg to the first end of the upper member.

14. The privacy screen apparatus of claim 13, wherein the second end of the upper member is connected to an inter-upper member connector device to connect the second leg to the second end of the upper member.

15. A privacy screen apparatus comprising:

an upper member having a first end and a second end;

at least one first leg connected to the first end of the upper member;

at least one second leg connected to the second end of the upper member;

a bendable body having a first edge and a second edge opposite the first edge, the body connected to the upper member adjacent to the first edge of the body and adjacent to the second edge of the body to define a pouch or channel below the upper member;

wherein the first end of the upper member is connected to a leg connector, the leg connector attaching the at least one first leg to the first end of the upper member;

wherein the second end of the upper member is connected to an inter-upper member connector device to connect the at least one second leg to the second end of the upper member; and wherein the upper member is a first upper member, the privacy screen apparatus also comprising a second upper member; and wherein the inter-upper member connector is positioned in a downward facing opening of the first upper member adjacent the second end of the first upper member and is also within a downward facing opening of the second upper member adjacent a first end of the second upper member to connect the first and second upper members together and to connect the at least one second leg to the first end of the second upper member;

a plurality of modesty screen connectors attached to the upper member within a lower downwardly facing opening defined in a bottom of the first upper member, each of the modesty screen connectors having a first projection extending in a first direction away from a body of the modesty screen connector and through a hole adjacent the first edge of the bendable body and a second projection extending in a second direction away from the body of the modesty screen connector and positioned through a hole adjacent the second edge of the bendable body, the second direction being opposite the first direction;

the modesty screen connectors attached to the first upper member such that the first and second projections of the modesty screen connectors are positioned below the first upper member.

16. The privacy screen apparatus of claim 15, wherein the first upper member has at least one outlet, the second upper member has at least one outlet and at least one cord is positionable in the pouch or channel.

17. The privacy screen apparatus of claim 15, wherein the bendable body is comprised of foam having a plurality of spaced apart recess regions and a plurality of spaced apart pillow regions, the pillow regions being thicker than the recess regions.

18. The privacy screen apparatus of claim 17, wherein the bendable body has a film or fabric covering attached to an exterior surface of the foam.

19. The privacy screen apparatus of claim 15, wherein the bendable body is U-shaped, C-shaped, or V-shaped when the body is connected to the first upper member adjacent the first edge and adjacent the second edge of the bendable body.

* * * * *